US005624548A

United States Patent [19]

Friedman et al.

[11] Patent Number: 5,624,548

[45] Date of Patent: Apr. 29, 1997

[54] HEAVY NAPHTHA HYDROCONVERSION PROCESS

[75] Inventors: Donn R. Friedman, Round Rock; Hsu-Hui Hsing, Nederland; Richard G. Nelson, Beaumont; Ooriapadical C. Abraham, Nederland, all of Tex.

[73] Assignee: Texaco Inc., White Plains, N.Y.

[21] Appl. No.: 278,979

[22] Filed: Jul. 21, 1994

[51] Int. Cl.[6] ..... C10G 7/02

[52] U.S. Cl. ..... 208/94; 208/92; 208/104

[58] Field of Search ..... 208/60, 92, 94, 208/104

[56] References Cited

U.S. PATENT DOCUMENTS 3,719,586 3/1973 Benner ..... 208/60

3,758,628 9/1973 Slrickland et al. ..... 208/60

4,647,368 3/1987 McGuiness et al. ..... 208/60

5,318,689 6/1994 Hsing et al. ..... 208/60

*Primary Examiner*—Helane Myers

*Attorney, Agent, or Firm*—Henry H. Gibson; Harold J. Delhommer; James L. Bailey

[57] ABSTRACT

A straight run naphtha is fractionated to yield on intermediate naphtha and the heaviest 10-25 vol % as heavy naphtha. The heavy naphtha is subjected to hydrocracking to yield liquid fuel and lighter, including $C_4$ isoparaffins and a cracked naphtha having a 90 vol % temperature (T90) of 310° F. (155° C.).

9 Claims, No Drawings

HEAVY NAPHTHA HYDROCONVERSION PROCESS

BACKGROUND OF THE INVENTION

1. Field of the Invention

The invention is a catalytic process for converting crude petroleum fractions to gasoline. More particularly the invention is a process for converting a heavy naphtha fraction by hydrocracking to improve the octane and reduce the volume of heavy end.

2. Description of Related Methods in the Field

In the refining of petroleum derived hydrocarbon oils, it is often desirable to subject the hydrocarbon oil to catalytic hydroprocessing in order to improve the suitability of the oil as a liquid fuel. Hydrocracking is a relatively severe hydroprocessing in which a petroleum distillate oil is passed together with hydrogen through a bed of catalyst which has specific activity for cracking relatively high molecular weight hydrocarbon oils to a lower molecular weight.

The molecular weight is selected to produce a boiling range in the liquid fuel boiling range. Such catalysts also have hydrogenation activity. Hydrogenation activity includes removal of unsaturation, organosulfur and organonitrogen. Unsaturation is converted to a more color stable saturation. Organosulfur and organonitrogen are converted to gaseous hydrogen sulfide and ammonia which are removed in a gas-liquid separator. Hydrocracking is used advantageously to convert petroleum distillate oil to relatively sulfur-free, nitrogen-free, color stable products such as gasoline, jet fuel and diesel fuel.

U.S. Pat. No. 5,318,689 to H. Hsing and R. E. Pratt discloses a process for converting heavy naphtha. The process utilizes fractionation to produce heavy naphtha and fluid catalytic cracking (FCC) to yield cracked naphtha and a $C_3$ to $C_5$ olefin fraction.

U.S. Pat. No. 3,758,628 to J. C. Strickland et al. discloses a process for converting low octane paraffinic naphtha to high octane gasoline. The process utilizes hydrocracking, alkylation, fluid catalytic cracking (FCC), catalytic reforming and solvent extraction.

SUMMARY OF THE INVENTION

A crude petroleum is fractionated to produce a straight run naphtha having a boiling range of about 90° F. (32.2° C.) to 430° F. (221.1° C.). The straight run naphtha fraction is fractionated to produce at least two essential fractions. The first is an intermediate naphtha fraction. The end point of the intermediate naphtha fraction is coincident with the initial boiling point of the second fraction, a heavy naphtha fraction having an initial boiling point of about 250° F. (121.1° C.) or higher. The heavy naphtha fraction is subjected to hydrocracking at a temperature of about 550° F. (287.7° C.) to 800° F. (726.6° C.); a pressure of about 21.4 atm. to 205 atm. and liquid hourly space velocity of about 0.1 to 10 vol heavy naphtha/hour/volume of catalyst (vol/hr/vol) to yield a liquid fuel and lighter fraction. The liquid fuel and lighter fraction is fractionated to yield an isoparaffin fraction and cracked naphtha. The cracked naphtha is characterized in having 90 vol % boiling at a temperature of 310° F. (155° C.) or lower.

The process has utility in producing a cracked naphtha which is a blending component for gasoline. When used as a fuel there is reduced hydrocarbon emission from an internal combustion engine.

DETAILED DESCRIPTION OF THE INVENTION

Feedstock for the process is crude petroleum. The source of the crude petroleum is not critical; however, Arabian light and West Texas intermediate are preferred feedstocks in the petroleum refining industry because these petroleums are rather light and have a relatively low viscosity compared with other whole crude petroleums. The viscosity of Arabian light petroleum is about 1.0 cp at 280° F. with a gravity of about 34.5° API. Other whole crude petroleum having a gravity of between about 33° API and 36° API are preferred and are considered premium grade because of their moderate gravity. In general crude petroleums having a gravity of 30° API and higher are desirable. Crude petroleums having a gravity of 20° API and lower are less desirable though they may be used as feedstocks to produce naphtha for the process.

Crude petroleum is subjected to a first cleaning process to remove water and salts as well as salt, clay, drilling mud, rust, iron sulfide and other matter commonly carried along with the material. Inorganic matter is removed by techniques well-known in the art. In a desalting process, crude petroleum is intimately mixed with salt free water. The crude petroleum and water are then separated with emulsion breaking techniques and a salt free petroleum recovered.

Salt free petroleum is subjected to fractional distillation in fractional distillation towers including a pipe still and a vacuum pipe still with lesser associated distillation towers. The resulting fractions range from the lightest hydrocarbon vapors including methane, ethane, ethylene, propane and propylene to the heaviest vacuum resid having an initial boiling point of 1100° F. (593° C.). Intermediate between propane and propylene and the heavy vacuum resid fractions are a number of intermediate fractions. The cut points of each of these intermediate fractions is determined by refinery configuration and product demand. These intermediate fractions include gasoline, naphtha, kerosene, diesel oil, gas oil and vacuum gas oil. Each of these fractions which is taken directly from one or more fractional distillations of crude petroleum is referred to in the art as "straight run." Applicants adopt this convention and by definition, intermediate fractions referred to as "straight run" are the direct product of fractional distillation of crude petroleum and have not been subjected to subsequent conversion such as catalytic or thermal conversion processes.

In response to refinery configuration and product demand a large body of technology has been developed for the conversion of one intermediate fraction to another. Straight run fractions differ from converted fractions particularly in the distribution of substituent components in the fraction. Typically they are higher in olefins, naphthenes and aromatic compounds as an artifact of catalytic or thermal processing. For example straight run naphtha is high in paraffins and low in olefins compared with naphthas derived from reforming or conversion processes.

According to the invention a crude petroleum is subjected to atmospheric and vacuum distillation to produce straight run intermediate distillate fractions. These include gasoline, naphtha, kerosene, diesel oil, gas oil and vacuum gas oil. These intermediate distillate fractions may be generally described as having an initial boiling point of about 90° F./32° C. ($C_5$) and having an end point of about 950° F. (510° C.) depending on the crude petroleum source.

Traditionally gasoline has had a boiling range of 90° F./32° C. ($C_5$) to 360° F. (182° C.). Naphtha has a boiling range of 90° F. (32° C.) to 430° F. (221° C.). Kerosene has a boiling range of 360° F. (182° C.) to 530° F. (276° C.). Diesel has a boiling range of 360° F. (182° C.) to about 650° F.–680° F. (343° C.–360° C.). The end point for diesel is 650° F. (343° C.) in the United States and 680° F. (360° C.) in Europe. Gas oil has an initial boiling point of about 650° F.–680° F. (343° C.–360° C.) and end point of about 800° F. (426° C.). The end point for gas oil is selected in view of process economics and product demand and is generally in the 750° F. (398° C.) to 800° F. (426° C.) range with 750° F. (398° C.) to 775° F. (412° C.) being most typical. Vacuum gas oil has an initial boiling point of 750° F. (398° C.) to 800° F. (426° C.) and an end point of 950° F. (510° C.) to 1100° F. (593° C.). The end point is defined by the hydrocarbon component distribution in the fraction as determined by an ASTM D-86 or ASTM D-1160 distillation. The gasoline, naphtha, kerosene and diesel portion is referred to in the art collectively as distillate fuel. The gas oil and vacuum gas oil portion is referred to as fluid catalytic cracking (FCC) feedstock or as fuel oil blending stock.

Though a number of fractions can be made, those functionally equivalent to fractions described herein are considered to fall within the scope of this invention: a straight run naphtha fraction, an intermediate naphtha and a heavy naphtha fraction.

The straight run naphtha fraction has heretofore been subjected to catalytic reforming to yield additional gasoline which has traditionally had a boiling range of 90° F./32° C. ($C_5$) to 400° F. (204° C.) with a 90 vol % distillation temperature of 335° F. (168° C.). A reduction in the 90 vol % distillation temperature has been shown to reduce the emission of carbon monoxide from gasoline fueled motor vehicles. It is therefore desirable to reduce the 90 vol % distillation temperature of gasoline to 310° F. (155° C.) or less, preferably 290° F. (143° C.).

A straight run naphtha is fractionated to remove the heaviest 5 vol % to 25 vol %, typically 10 vol % to 15 vol % to produce an intermediate naphtha fraction. Inventors found and disclosed in U.S. Pat. No. 5,318,689 that this intermediate naphtha fraction when subjected to catalytic reforming, produces a gasoline with the desired reduced 90 vol % distillation temperature. This 90 vol % distillation temperature is referred to in the art as the T90 temperature or T90 point. The T90 point is determined from an ASTM D-86 distillation of a sample of the fraction.

Accordingly, the straight run naphtha is fractionated to yield an intermediate naphtha fraction and a heavy naphtha fraction. The end point of the intermediate is nominally coincident with the initial boiling point of the heavy naphtha. In this regard, the separation is defined by the initial boiling point of the heavy naphtha fraction which is 250° F. (121° C.) or higher, preferably 275° F. (135° C.) or higher. End point of the heavy naphtha fraction is the same as the end point of the straight run naphtha fraction from which it is made.

The heavy naphtha fraction is next subjected to catalytic hydrocracking. The hydrocracking reaction is carried out in one or a series of reaction zones and it may be preceded by hydrotreating for removal of contaminants such as sulfur, nitrogen and metals from the chargestock. Such hydrotreating reactions to remove contaminants are generally carried out under milder conditions than those employed in the hydrocracking reaction and the conversion of hydrocarbons to lower boiling fractions is relatively small. Therefore such hydrotreating, carried out in addition to the present process, does not substantially change the conversion of the heavy naphtha fraction to liquid fuels.

In the hydrocracking reaction, the temperature is generally maintained between 550° F. (287° C.) and 800° F. (726.6° C.) and a pressure in the range of 330 psig (21.4 atm) to 3000 psig (205 atm). The liquid hourly space velocity is between about 0.1 to 10 volume of oil per hour per volume of catalyst (vol/hr/vol) and the hydrogen rate is between about 1000 and 50,000 standard cubic feet of hydrogen per barrel of hydrocarbon charge. Preferably the hydrocracking reaction temperature is between about 650° F. (343.3° C.) and 750° F. (398.9° C.), the pressure is between about 500 psig (35 atm) to 1500 psig (103 atm) and the liquid hourly space velocity is about 0.5 to 5 volume of oil per hour per volume of catalyst (vol/hr/vol). The preferred hydrogen rate is about 3000 to about 15,000 standard cubic feet per barrel. The preferred temperature will vary somewhat with the catalyst used and is therefore an optimization in the inventive range.

The hydrocracking catalyst may be any hydrocracking catalyst which under hydrocracking reaction conditions will hydrocrack the heavy naphtha fraction to yield a liquid fuel boiling in the range of $C_5$ and 430° F. (221° C.) and an isoparaffin fraction comprising $C_4$, $C_5$ and $C_6$ isoparaffins, particularly isobutane.

These hydrocracking catalysts comprise a hydrogenation component and a cracking compound.

Suitable hydrogenation components may be selected from Group VIII metals, their compounds and mixtures thereof. Additionally, suitable hydrogenation components may be selected from Group XIII metals, their compounds and mixtures thereof in combination with Group VI metals, their compounds and mixtures thereof. Metals of Group VIII of the periodic table and compounds thereof which are useful as hydrogenation components include nickel, cobalt, platinum, palladium and compounds thereof. Metals of Group VI of the periodic table and compounds thereof which are suitable hydrogenation components include molybdenum, tungsten, chromium and compounds thereof.

The cracking component of the hydrocracking catalyst is preferably a solid, acidic component having high cracking activity. Suitable cracking components include silica-alumina, silica-alumina-zirconia, silica-alumina-titania, acid-treated clays and zeolitic molecular sieves. An effective cracking component comprises a mixture of a modified crystalline silica-alumina zeolite and at least one amorphous inorganic oxide, with the modified zeolite being present in an amount between about 15 and 60% by weight of the cracking component. Suitable amorphous inorganic oxides are those having cracking activity such as silica, alumina, magnesia, zirconia, titania and beryllia which may have been treated with an acidic agent such as hydrochloric acid to impart cracking activity thereto. The modified zeolite portions of the cracking catalyst may be of the X or Y type having uniform pore openings of from about 4 to 14 Å and having a silica-alumina ratio of from about 2.5 to 10. Preferably the modified zeolite is in the hydrogen form or a divalent metal form with the major portion of monovalent metal cations removed therefrom by ion exchange. Monovalent metal cations such as sodium, may be present in the modified zeolite in amounts up to about 4 percent, however, the monovalent metal cation concentration is preferably below about 1%.

Hydrocracking catalysts comprise a hydrogenating component supported on a cracking component. The hydrogenation component may be combined with the cracking component by methods well-known in the art such as by impregnation, cogellation or combination of these procedures. When the hydrogenation component of the hydrocracking catalyst is a noble metal, such as platinum and palladium, it should be present in an amount between about 0.2 and 5.0% by weight based on the total catalyst composite. Preferably the noble metal is present in an amount between 0.5 and 2%. When the hydrogenation component comprises other members of Group VIII such as nickel and cobalt in conjunction with Group VI metals, the Group VIII metals should be present in an amount between about 2 and 10% and the Group VI metals present in an amount between about 5 and 30% by weight of the total catalyst composite.

A specific hydrocracking catalyst suitable for use in this process is one containing about 0.75, wt % palladium upon a support made up of about 22% modified zeolite Y, 58% silica and 20% alumina. Another suitable hydrocracking catalyst is one containing about 6% nickel and 20% tungsten on a support made up of about 22% modified zeolite Y, 58% silica and 20% alumina. When used in a sulfide form, the catalyst may be converted thereto by methods well-known in the art such as by subjecting the catalyst at a temperature between about 400° F. and 600° F. to contact with a sulfiding agent, for example, hydrogen containing 10–20% hydrogen sulfide or a carbon disulfide-oil mixture.

The alkylation reaction contemplated in this invention comprises the acid catalyzed reaction between a light olefin and a low molecular weight isoparaffin. The light olefin is supplied by the isoparaffin fraction comprising $C_4$, $C_5$ and $C_6$ isoparaffins and particularly isobutane as a substantial portion of the fraction.

The olefin is a straight or branched hydrocarbon containing one and most preferably not more than one carbon-carbon double bonds. It contains 2 to 20 carbon atoms and most preferably 3 to 5 carbon atoms.

The alkylation reaction is catalyzed by a liquid acid such as hydrofluoric acid, sulfuric acid, phosphoric acid and the like, or mixtures thereof. In the alkylation reaction zone, the alkylation catalyst comprises an anhydrous mixture of about 50 vol % to 99.9 vol % of the liquid acid, preferably 90.0 vol % to 99.9 vol % liquid acid.

Alkylation conditions generally include a pressure sufficient to maintain the hydrocarbons and acid in the liquid phase, and generally range from about 1 to 40 atmospheres. The alkylation reaction may take place at temperatures of from 0° C. to 390° C. with a range of 0° C. to 275° C. being preferred. The reaction is carried out at a liquid hourly space velocity ranging from 0.1 to 100 vol/hr/vol and preferably 0.5 to 60 vol/hr/vol.

The alkylation reaction results in a high octane gasoline blending component, referred to in the art as alkylate. Alkylate is advantageously combined with the cracked naphtha of the process to yield a high octane liquid fuel.

This invention is shown by way of example.

EXAMPLE

The feedstock described in Table 1 was hydrocracked using Akzo KC-2001 brand, a commercially available hydrocracking catalyst. This catalyst is described in Table 2. Hydrocracking conditions are reported in Table 3.

The hydrocracked product was fractionated to remove the $C_5$ and lighter end. The resulting cracked naphtha product was analyzed for boiling range distribution according to ASTM D-86. The most significant T90 reduction was achieved at conditions of 2 LHSV, 1000 psig, 650° F. and 4 LHSV, 1000 psig, 700° F. Accordingly, this is the Best Mode contemplated by inventors for carrying out the invention.

Product sulfur ranged from 8 to 22 wppm. Product nitrogen ranged from 0.04 to 0.12 wppm. Liquid product Research Octane Number (RON) ranged from 52 to 78 and Motor Octane (MON) ranged from 51 to 74. These octane numbers made the cracked naphtha suitable for blending into gasoline.

Table 4 reports the component distribution of the product. The product contained significant amounts of $C_4$ and $C_5$ isoparaffins. The amount of $C_{10}^+$ product was greatly reduced, consistent with the reduced T90.

The data demonstrate an operating range as follows:

| | Full Range | Preferred Range |
|---|---|---|
| Catalyst Bed Temperature | 550–800° F. | 650–750° F. |
| Pressure | 300–3000 psig | 500–1500 psig |
| LHSV | 0.1–10 vol/hr/vol | 0.5–5 vol/hr/vol |
| Hydrogen rate | 500–5000 SCFB | 2000–3500 SCFB |

TABLE 1

| FEED PROPERTIES | |
|---|---|
| API Gravity | 48.9° |
| Aniline Point, °F. | 115 |
| Bromine No. | 15.6 |
| Olefins, Vol % | 1.9 |
| Watson Aromatics, wt % | 40.7 |
| X-Ray Sulfur, wt % | 0.1084 |
| Total $N_2$, wppm | 4.83 |
| RON | 36 |
| MON | 42.2 |
| Distillation | ASTM D-86 |
| IBP (initial boiling point) | 275° F. |
| 5 | 299 |
| 10 | 300 |
| 20 | 303 |
| 30 | 306 |
| 40 | 310 |
| 50 | 314 |
| 60 | 318 |
| 79 | 324 |
| 80 | 331 |
| 90 | 344 (T90) |
| 95 | 363 |
| EP (end point) | 376 |

TABLE 2

| CATALYST TEST RESULTS | |
|---|---|
| Catalyst | Akzo KC-2001 Ni—Mo/Zeolite |
| Physical Properties: | |
| Surface Area (BET), $M^2/g$ | 434 |
| Pore volume, $H_2O$ titration, cc/g | 0.34 |
| Pour density, lbs/ft$^3$ | 48.8 |
| Pack density, lbs/ft$^3$ | 49.5 |
| Diameter Avg., mm | 1.63 |
| Avg. Crush, lbs | 11.75 |

TABLE 3

HEAVY STRAIGHT RUN NAPHTHA BOTTOMS HYDROCRACKING RESULTS

| Example | 1 | 2 | 3 | 4 | 5 | 6 | 7 | 8 | 9 |
|---|---|---|---|---|---|---|---|---|---|
| Operting Conditions | | | | | | | | | |
| LHSV (v/hr/v) | 4.02 | 4.08 | 1.99 | 1.99 | 4.06 | 3.91 | 3.95 | 2.02 | 2.01 |
| Cat. temp. (avg) °F. | 674 | 625 | 650 | 602 | 698 | 701 | 650 | 675 | 627 |
| Press. (psig) | 1001 | 1001 | 1000 | 1000 | 1000 | 499 | 500 | 500 | 500 |
| $H_2$ (psia) | 679 | 775 | 685 | 784 | 658 | 383 | 409 | 373 | 409 |
| Feed treating gas rate, SCFB | 3500 | 3500 | 3500 | 3500 | 3500 | 3500 | 3500 | 3500 | 3500 |
| $H_2$ purity, vol % | 100 | 100 | 100 | 100 | 100 | 100 | 100 | 100 | 100 |
| Liquid Product Properties: | | | | | | | | | |
| API gravity | 63.62° | 58.58° | 64.85° | 58.95° | 64.93° | 60.03° | 54.69° | 64.32° | 55.68° |
| MON | 72.0 | 60.3 | 74.1 | 60.6 | 72.7 | 63.4 | 51.4 | 70.0 | 53.4 |
| RON | 76.7 | 61.6 | 77.2 | 61.7 | 77.8 | 66.2 | 52.2 | 73.4 | 55.6 |
| Total S, wt % | 0.0014 | 0.0022 | 0.0020 | 0.0009 | 0.0013 | 0.0007 | 0.0012 | 0.0017 | 0.0008 |
| Total N, wppm | 0.06 | 0.08 | 0.12 | 0.05 | 0.05 | 0.05 | 0.04 | 0.09 | 0.09 |
| ASTM D-86 Dist. | | | | | | | | | |
| IBP | 82 | 79 | 80 | 80 | 83 | 82 | 95 | 77 | 93 |
| 5 | 106 | 120 | 106 | 119 | 104 | 109 | 166 | 98 | 148 |
| 10 | 120 | 151 | 118 | 146 | 116 | 128 | 216 | 112 | 188 |
| 20 | 139 | 213 | 134 | 201 | 131 | 170 | 270 | 146 | 252 |
| 30 | 158 | 255 | 150 | 245 | 145 | 217 | 285 | 184 | 276 |
| 40 | 182 | 276 | 171 | 270 | 165 | 254 | 298 | 224 | 290 |
| 50 | 211 | 290 | 197 | 286 | 188 | 276 | 304 | 256 | 299 |
| 60 | 241 | 297 | 226 | 296 | 220 | 291 | 311 | 277 | 306 |
| 70 | 266 | 307 | 256 | 305 | 253 | 301 | 319 | 292 | 314 |
| 80 | 287 | 318 | 279 | 316 | 279 | 312 | 328 | 307 | 324 |
| 90 | 307 | 339 | 302 | 335 | 302 | 330 | 345 | 322 | 342 |
| 95 | 323 | NA | 321 | 364 | 321 | 357 | 381 | NA | 386 |
| EP | 363 | 387 | 357 | 384 | 359 | 376 | 392 | 389 | 388 |
| T90, °F. (Corrected to include $C_5^+$) | 307 | 343 | 302 | 339 | 302 | 334 | 348 | 327 | 344 |
| Δ T90, °F. (Feedstock-Product) | −37 | −1 | −42 | −5 | −42 | −10 | 4 | −17 | — |

TABLE 4

HYDROCRACKING PRODUCT SELECTIVITIES (PIONA)

| Example<br>Product Selectivities, vol % | Feed | 1 | 2 | 3 | 4 | 5 | 6 | 7 | 8 | 9 |
|---|---|---|---|---|---|---|---|---|---|---|
| Paraffins | | | | | | | | | | |
| $iC_4$ | 0.00 | 17.01 | 6.61 | 19.37 | 6.71 | 19.03 | 8.75 | 3.74 | 12.54 | 4.78 |
| $nC_4$ | 0.00 | 6.79 | 2.56 | 7.37 | 2.56 | 8.14 | 4.43 | 1.73 | 5.28 | 2.14 |
| $nC_5$ | 0.01 | 16.60 | 7.10 | 17.97 | 8.04 | 18.66 | 10.54 | 3.78 | 13.17 | 5.17 |
| $nC_5$ | 0.07 | 1.59 | 0.51 | 2.01 | 0.56 | 2.23 | 1.04 | 0.32 | 1.15 | 0.35 |
| $iC_6$ | 0.45 | 10.17 | 5.01 | 10.90 | 5.58 | 11.10 | 6.80 | 2.64 | 8.39 | 3.49 |
| $nC_6$ | 0.93 | 0.91 | 0.29 | 1.12 | 0.33 | 1.28 | 0.60 | 0.19 | 0.66 | 0.20 |
| $iC_7$ | 1.33 | 3.01 | 2.25 | 2.98 | 2.45 | 2.58 | 2.32 | 1.19 | 2.77 | 1.61 |
| $nC_7$ | 2.00 | 0.42 | 0.30 | 0.44 | 0.32 | 0.42 | 0.35 | 0.29 | 0.38 | 0.31 |
| $iC_8$ | 2.90 | 1.60 | 1.66 | 0.73 | 1.52 | 0.73 | 0.91 | 1.03 | 0.79 | 1.12 |
| $nC_8$ | 3.57 | 1.35 | 2.04 | 1.72 | 2.52 | 1.46 | 2.43 | 2.56 | 2.33 | 2.65 |
| $iC_9$ | 8.37 | 2.28 | 6.30 | 1.83 | 6.52 | 1.43 | 5.04 | 7.16 | 3.77 | 6.88 |
| $nC_9$ | 10.70 | 5.08 | 9.92 | 4.16 | 9.72 | 3.91 | 8.58 | 10.78 | 7.30 | 10.47 |
| $iC_{10}$ | 14.20 | 1.23 | 8.02 | 0.84 | 7.25 | 0.73 | 6.52 | 12.28 | 3.89 | 10.49 |
| $nC_{10}$ | 5.42 | 2.01 | 5.11 | 1.51 | 5.03 | 1.43 | 4.14 | 5.82 | 3.37 | 5.41 |
| $iC_{11}$ | 4.25 | 0.00 | 1.48 | 0.00 | 0.81 | 0.00 | 0.83 | 2.73 | 0.24 | 2.17 |
| $nC_{11}$ | 1.61 | 0.57 | 1.64 | 0.00 | 2.18 | 0.34 | 1.76 | 2.32 | 1.23 | 1.78 |
| Naphthenes | | | | | | | | | | |
| $C_5$ | 0.02 | 0.40 | 0.12 | 0.46 | 0.12 | 0.51 | 0.24 | 0.08 | 0.30 | 0.09 |
| $C_6$ | 0.38 | 3.85 | 2.55 | 4.15 | 2.82 | 3.71 | 2.79 | 1.28 | 3.40 | 1.72 |
| $C_7$ | 1.03 | 3.37 | 2.44 | 3.66 | 2.70 | 3.10 | 2.46 | 1.40 | 2.96 | 1.85 |
| $C_8$ | 2.43 | 3.47 | 2.92 | 3.54 | 2.96 | 2.54 | 2.26 | 1.90 | 2.65 | 2.30 |
| $C_9$ | 6.37 | 2.90 | 7.13 | 1.45 | 6.64 | 1.56 | 2.99 | 6.88 | 2.53 | 7.03 |
| $C_{10}$ | 4.40 | 0.24 | 2.44 | 0.18 | 2.27 | 0.11 | 1.63 | 4.40 | 0.90 | 3.85 |
| $C_{11}$ | 1.94 | 0.00 | 0.34 | 0.00 | 0.00 | 0.00 | 0.19 | 1.18 | 0.00 | 0.89 |
| Aromatics | | | | | | | | | | |
| $C_6$ | 0.08 | 0.97 | 0.86 | 0.99 | 0.86 | 1.10 | 1.23 | 0.98 | 1.21 | 0.96 |

TABLE 4-continued

HYDROCRACKING PRODUCT SELECTIVITIES (PIONA)

| Example Product Selectivities, vol % | Feed | 1 | 2 | 3 | 4 | 5 | 6 | 7 | 8 | 9 |
|---|---|---|---|---|---|---|---|---|---|---|
| $C_7$ | 0.61 | 3.89 | 3.26 | 3.65 | 3.44 | 4.12 | 4.62 | 3.23 | 4.75 | 3.44 |
| $C_8$ | 4.26 | 5.31 | 5.97 | 4.61 | 6.00 | 5.34 | 7.30 | 6.13 | 7.02 | 6.36 |
| $C_9$ | 10.74 | 3.26 | 5.73 | 2.67 | 5.25 | 3.02 | 5.53 | 7.06 | 4.53 | 6.54 |
| $C_{10}$ | 7.17 | 1.58 | 3.95 | 1.10 | 3.57 | 1.32 | 2.76 | 4.34 | 2.10 | 4.01 |
| Polynuclear Aromatics | 0.94 | 0.01 | 0.00 | 0.01 | 0.03 | 0.01 | 0.03 | 0.03 | 0.01 | 0.00 |
| >200° | 3.92 | 0.56 | 1.46 | 0.56 | 1.24 | 0.07 | 0.94 | 2.56 | 0.39 | 2.12 |

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A process for hydrocracking a heavy naphtha fraction derived from crude petroleum to yield a cracked naphtha and an isoparaffin fraction comprising:

a. fractionating crude petroleum to produce a straight run naphtha fraction having a boiling range of about 90° F. to 430° F.;

b. fractionating the straight run naphtha fraction to produce at least two fraction comprising:

i. an intermediate naphtha fractions, and ii. a heavy naphtha fraction having an initial boiling point of about 250° F. or higher;

c. contacting the heavy naphtha fraction with a hydrocracking catalyst at a hydrocracking reaction temperature of about 550° F. to 800° F., pressure of 300 psig to 3000 psig and liquid hourly space velocity of about 0.1 to 10 vol/hr/vol to yield a liquid fuel and lighter fraction;

d. fractionating the liquid fuel and lighter fraction to yield an isoparaffin fraction and cracked naphtha characterized in having 90 vol % boiling at a temperature of 310° F. or lower.

2. The process of claim 1 wherein the step b. the heavy naphtha fraction initial boiling point is 275° F. or higher.

3. The process of claim 1 wherein the step c. the hydrocracking reaction temperature is about 650° F. to 750° F., pressure is about 500 psig to 1500 psig and liquid hourly space velocity is about 0.5 to 5 vol/hr/vol.

4. The process of claim 1 additionally comprising:

mixing the isoparaffin fraction of step d. with a light olefin selected from the group consisting of $C_3$, $C_4$ and $C_5$ olefins and mixtures thereof; and subjecting the resulting mixture to alkylation reaction conditions to produce an alkylate.

5. The process of claim 1 additionally comprising:

mixing the isoparaffin fraction of step d. with a light olefin selected from the group consisting of $C_3$, $C_4$, and $C_5$ olefins and mixtures thereof; and subjecting the resulting mixture to alkylation reaction conditions to produce an alkylate; and combining the alkylate with the cracked naphtha to yield a high octane liquid fuel.

6. A process for hydrocracking a heavy naphtha fraction derived from crude petroleum to yield a cracked naphtha and an isoparaffin fraction comprising:

a. fractionating crude petroleum to produce a straight run naphtha fraction having a boiling range of about 90° F. to 430° F.;

b. fractionating the straight run naphtha fraction to produce at least two fractions comprising:

i. an intermediate naphtha fraction, and ii. a heavy naphtha fraction having an initial boiling point of about 250° F. or higher;

c. contacting the heavy naphtha fraction with a hydrocracking catalyst at hydrocracking reaction conditions including a hydrocracking reaction temperature of about 625° F. to 700° F., pressure of 500 psig to 1000 psig to yield a liquid fuel and lighter fraction;

d. fractionating the liquid fuel and lighter fraction to yield a $C_4$–$C_5$ isoparaffin fraction and cracked naphtha characterized in having 90 vol % boiling at a temperature of 300° F. or lower.

7. The process of claim 6 wherein in step b. the heavy naphtha fraction initial boiling point is 275° F. or higher.

8. The process of claim 6 additionally comprising:

mixing the isoparaffin fraction of step d. with a light olefin selected from the group consisting of $C_3$, $C_4$ and $C_5$ olefins and mixtures thereof; and subjecting the resulting mixture to alkylation reaction conditions to produce a $C_7$ to $C_{10}$ alkylate.

9. The process of claim 6 additionally comprising:

mixing the isoparaffin fraction of step d. with a light olefin selected from the group consisting of $C_3$, $C_4$ and $C_5$ olefins and mixtures thereof; and subjecting the resulting mixture to alkylation reaction conditions to produce a $C_7$ to $C_{10}$ alkylate; and combining the $C_7$ to $C_{10}$ alkylate with the cracked naphtha to yield a high octane liquid fuel.

* * * * *